US008721392B2

(12) United States Patent
Brown et al.

(10) Patent No.: US 8,721,392 B2
(45) Date of Patent: May 13, 2014

(54) GLASS EDGE FINISHING METHOD

(75) Inventors: James William Brown, Painted Post, NY (US); Siva Venkatachalam, Painted Post, NY (US)

(73) Assignee: Corning Incorporated, Corning, NY (US)

( * ) Notice: Subject to any disclaimer, the term of this patent is extended or adjusted under 35 U.S.C. 154(b) by 398 days.

(21) Appl. No.: 13/170,728

(22) Filed: Jun. 28, 2011

(65) Prior Publication Data

US 2013/0005222 A1 Jan. 3, 2013

(51) Int. Cl.
*B24B 9/08* (2006.01)
*B24B 9/10* (2006.01)

(52) U.S. Cl.
USPC ..... 451/44; 451/43; 451/63

(58) Field of Classification Search
USPC ..... 451/41, 43, 44, 63
See application file for complete search history.

(56) References Cited

U.S. PATENT DOCUMENTS

| | | | | | |
|---|---|---|---|---|---|
| 2,022,530 | A | | 11/1935 | White | 51/278 |
| 3,111,790 | A | | 11/1963 | Vegors et al. | 51/105 |
| 4,054,010 | A | * | 10/1977 | Shipman | 451/159 |
| 4,060,938 | A | * | 12/1977 | Barron, Sr. | 451/260 |
| 4,128,972 | A | | 12/1978 | Charvat | 51/298 |
| 4,467,168 | A | | 8/1984 | Morgan et al. | 219/121 |
| 4,575,970 | A | * | 3/1986 | Kozai et al. | 451/26 |
| 4,594,814 | A | * | 6/1986 | Olszewski et al. | 451/44 |
| 4,654,051 | A | * | 3/1987 | Orita et al. | 51/298 |
| 4,908,996 | A | | 3/1990 | Friedman et al. | 51/284 |
| 5,128,281 | A | * | 7/1992 | Dyer et al. | 438/693 |
| 5,143,196 | A | | 9/1992 | Henn et al. | 198/345.3 |
| 5,146,715 | A | * | 9/1992 | Bando | 451/11 |
| 5,148,632 | A | | 9/1992 | Adler et al. | 51/55 |
| 5,185,959 | A | | 2/1993 | Ikola et al. | 51/72 |
| 5,273,558 | A | | 12/1993 | Nelson et al. | 51/298 |
| 5,295,331 | A | * | 3/1994 | Honda et al. | 451/44 |
| 5,306,319 | A | | 4/1994 | Krishnan et al. | 51/298 |
| 5,366,526 | A | | 11/1994 | Ellison-Hayashi et al. | 51/307 |
| 5,409,417 | A | | 4/1995 | Bando | 451/9 |
| 5,410,843 | A | * | 5/1995 | Gottschald | 451/43 |
| 5,423,717 | A | | 6/1995 | Boaz | 451/449 |
| 5,456,735 | A | | 10/1995 | Ellison-Hayashi et al. | 51/307 |
| 5,492,550 | A | | 2/1996 | Krishnan et al. | 51/298 |
| 5,514,025 | A | * | 5/1996 | Hasegawa et al. | 451/44 |
| 5,545,277 | A | * | 8/1996 | Hashemi et al. | 156/106 |

(Continued)

FOREIGN PATENT DOCUMENTS

| | | | |
|---|---|---|---|
| DE | 8503914 | 7/1985 | B24B 9/10 |
| EP | 0601748 A1 | 11/1993 | B24B 9/06 |

(Continued)

OTHER PUBLICATIONS

PCT/UA2012/044599 Search Report.

*Primary Examiner* — Lee D Wilson
*Assistant Examiner* — Tyrone V Hall, Jr.
(74) *Attorney, Agent, or Firm* — Matthew J. Mason; William J. Tucker

(57) ABSTRACT

A method for finishing an edge of a glass sheet comprising a first grinding step and a second polishing step using different abrasive wheels. The method results in consistent finished edge quality and improved edge quality in term of sub-surface damage (SSD). The method can be advantageously utilized to finish the edges of a thin glass substrate for use as substrates of display devices, such as LCD displays and the like.

25 Claims, 3 Drawing Sheets

(56) References Cited

U.S. PATENT DOCUMENTS

| | | | | | |
|---|---|---|---|---|---|
| 5,609,254 | A | | 3/1997 | Loftus et al. | 206/506 |
| 5,622,540 | A | | 4/1997 | Stevens | 65/112 |
| 5,630,746 | A | * | 5/1997 | Gottschald et al. | 451/5 |
| 5,655,956 | A | | 8/1997 | Ferreira et al. | 451/143 |
| 5,658,189 | A | * | 8/1997 | Kagamida | 451/66 |
| 5,674,110 | A | | 10/1997 | Cuoghi | 451/44 |
| 5,727,990 | A | * | 3/1998 | Hasegawa et al. | 451/44 |
| 5,816,897 | A | * | 10/1998 | Raeder et al. | 451/44 |
| 5,928,070 | A | * | 7/1999 | Lux | 451/526 |
| 5,944,584 | A | | 8/1999 | Toyama | 451/41 |
| 5,975,992 | A | * | 11/1999 | Raeder et al. | 451/44 |
| 6,091,078 | A | | 7/2000 | Codama | 257/40 |
| 6,099,385 | A | | 8/2000 | Stock et al. | 451/8 |
| 6,196,902 | B1 | * | 3/2001 | Gazca-Ortiz et al. | 451/242 |
| 6,216,491 | B1 | | 4/2001 | Fehlner | 65/25.3 |
| 6,302,769 | B1 | * | 10/2001 | Nishi et al. | 451/44 |
| 6,325,704 | B1 | * | 12/2001 | Brown et al. | 451/44 |
| 6,428,390 | B1 | | 8/2002 | Clark et al. | 451/11 |
| 6,676,488 | B2 | | 1/2004 | Brown et al. | 451/41 |
| 6,685,541 | B2 | | 2/2004 | Brown et al. | 451/41 |
| 6,755,724 | B2 | | 6/2004 | Shin et al. | 451/64 |
| 7,018,272 | B2 | | 3/2006 | Allaire et al. | 451/11 |
| 7,507,146 | B2 | * | 3/2009 | Kato et al. | 451/41 |
| 2003/0054736 | A1 | | 3/2003 | Hagan et al. | 451/44 |
| 2006/0128154 | A1 | | 6/2006 | Miyahara et al. | 438/692 |
| 2010/0190416 | A1 | * | 7/2010 | Schwarzenbach et al. | 451/44 |
| 2010/0266874 | A1 | | 10/2010 | Uchiyama et al. | 428/846.9 |

FOREIGN PATENT DOCUMENTS

| | | | | | |
|---|---|---|---|---|---|
| EP | 0601748 | B1 | | 11/1993 | B24B 9/06 |
| EP | 0687524 | A1 | | 6/1995 | B24B 9/06 |
| EP | 0687524 | B1 | | 6/1995 | B24B 9/06 |
| EP | 0759339 | | | 2/1997 | B24B 9/00 |
| EP | 826459 | A1 | * | 3/1998 | B24B 9/06 |
| JP | 63102860 | | | 7/1988 | B24B 9/00 |
| JP | 11151646 | | | 8/1999 | B24B 9/00 |
| JP | 11151647 | | | 8/1999 | B24B 9/08 |

* cited by examiner

GLASS EDGE FINISHING METHOD

TECHNICAL FIELD

The present invention relates to edge finishing methods of glass materials. In particular, the present invention relates to grinding and polishing of the edge of a thin glass sheet. The present invention is useful, e.g., in finishing the edge of a glass sheet for use as a substrate for making a display device, such as LCD display.

BACKGROUND

Thin glass sheets have found use in many optical, electrical or optoeletrical devices, such as liquid crystal (LCD) displays, organic light-emitting diode (OLED) displays, solar cells, as semiconductor device substrates, color filter substrates, cover sheets, and the like. The thin glass sheets, having a thickness of from several micrometers to several millimeters, may be fabricated by a number of methods, such as float process, fusion down-draw process (a method pioneered by Corning Incorporated, Corning, N.Y., U.S.A.), slot down-draw process, and the like. It is highly desired that these glass substrates have high strength, so that they can withstand the mechanical impact that they may encounter during finishing, packaging, transportation, handling, and the like. The atomic network of glass materials is intrinsically strong. However, defect in the surface of a glass sheet, including the major surface and edge surface, can propagate quickly into the network when subject to stress over a certain threshold. Because these substrates normally have relatively high main surface quality with low number of scratches and the like, their strength are largely determined by the edge quality. An edge with small amounts of defects is highly desired for high edge strength of a glass material.

The production of a glass sheet frequently includes a step of cutting by mechanical score-and-break, laser score-and-break or direct laser full-body cutting. Those processes invariably result in a glass sheet having two major surfaces connected by an edge surface substantially perpendicular to the major surfaces. Thus, at the intersection regions between the major surfaces and the edge surface, one may observe sharp, 90° corners. When under a microscope, one can observe a large number of defects such as cracks in the corners, especially where mechanical scoring is used. These corners, when impacted during packaging, handling and use, can easily break, leading to chipping, crack propagation and even sheet rupture, none of which is desirable.

Traditionally, the pre-finishing edges of a glass sheet has been ground and optionally polished. However, the existing finishing methods suffered from one of the more of the following drawbacks: (i) insufficient resultant edge quality; (ii) low throughput; and (iii) low consistency of finished edge quality. Besides, as the glass sheets used for the displays are becoming thinner and thinner, existing finishing methods acceptable for glass sheets with large thickness were found inadequate.

Thus, there is a genuine need of an improved glass sheet edge finishing method. The present invention meets this and other needs.

SUMMARY

Several aspects of the present invention are disclosed herein. It is to be understood that these aspects may or may not overlap with one another. Thus, part of one aspect may fall within the scope of another aspect, and vice versa.

Each aspect is illustrated by a number of embodiments, which, in turn, can include one or more specific embodiments. It is to be understood that the embodiments may or may not overlap with each other. Thus, part of one embodiment, or specific embodiments thereof, may or may not fall within the ambit of another embodiment, or specific embodiments thereof, and vice versa.

Thus, a first aspect of the present disclosure is related to a method for finishing an edge of a glass sheet having a thickness Th(gs), a first major surface, a second major surface, and a first pre-finishing edge surface connecting the first major surface with the second major surface, a first corner defined by the intersection between the first major surface and the first pre-finishing edge surface, and a second corner defined by the intersection between the second major surface and the first pre-finishing edge surface, comprising the following steps:

(I) grinding the first edge surface, the first corner and the second corner to obtain a curved first ground edge surface with substantially no sharp corner having an as-ground maximal crack length MCL(g), an as-ground average crack length ACL(g), and an as-ground normalized average number of cracks ANC(g); and subsequently (II) polishing the first ground edge surface to obtain a first polished edge surface having an as-polished maximal crack length MCL(p), an as-polished average crack length ACL(p), and an as-polished normalized average number of cracks ANC(p); wherein MCL(p)/MCL(g)≤¾, ACL(p)/ACL(g)≤¾, and ANC(p)/ANC(g)≤¾.

In certain embodiments of the method according to the first aspect of the present disclosure, MCL(p)/MCL(g)≤⅔, ACL(p)/ACL(g)≤⅔, and ANC(p)/ANC(g)≤⅔.

In certain embodiments of the method according to the first aspect of the present disclosure, MCL(p)/MCL(g)≤½, ACL(p)/ACL(g)≤½, and ANC(p)/ANC(g)≤½.

In certain embodiments of the method according to the first aspect of the present disclosure, MCL(p)/MCL(g)≤⅓, ACL(p)/ACL(g)≤⅓, and ANC(p)/ANC(g)≤⅓.

In certain embodiments of the method according to the first aspect of the present disclosure, MCL(g)≤40 μm, ACL(g)≤10 μm, and ANC(p)≤40 $mm^{-1}$.

In certain embodiments of the method according to the first aspect of the present disclosure, in step (I), a grinding wheel comprising a plurality of grinding grits embedded in a grinding wheel matrix is used, and the grinding grits have an average particle size of from 10 μm to 80 μm, in certain embodiments from 20 μm to 65 μm, in certain embodiments from 20 μm to 45 μm, in certain embodiments from 20 μm to 40 μm.

In certain embodiments of the method according to the first aspect of the present disclosure, the grinding grits comprise a material selected from diamond, SiC, $Al_2O_3$, SiN, CBN (cubic boron nitride), $CeO_2$, and combinations thereof.

In certain embodiments of the method according to the first aspect of the present disclosure, in step (I), a grinding force F(g) is applied by the grinding wheel to the glass sheet, and F(g)≤30 newton, in certain embodiments F(g)≤25 newton, in certain embodiments F(g)≤20 newton, in certain embodiments F(g)≤15 newton, in certain embodiments F(g)≤10 newton, in certain embodiments F(g)≤8 newton, in certain embodiments F(g)≤6 newton, in certain embodiments F(g)≤4 newton.

In certain embodiments of the method according to the first aspect of the present disclosure, in step (II), a polishing wheel comprising a plurality of polishing grits embedded in a polishing wheel polymer matrix is used, and the polishing grits have an average particle size of from 5 μm to 80 μm, in certain embodiments from 6 μm to 65 μm, in certain embodiments from 7 μm to 50 μm, in certain embodiments from 8 μm to 40 μm, in certain embodiments from 5 μm to 20 μm, in certain embodiments from 8 μm to 20 μm.

In certain embodiments of the method according to the first aspect of the present disclosure, in step (II), a polishing force F(p) is applied by the polishing wheel to the glass sheet, and F(p)≤30 newton, in certain embodiments F(p)≤25 newton, in certain embodiments F(p)≤20 newton, in certain embodiments F(p)≤15 newton, in certain embodiments F(p)≤10 newton, in certain embodiments F(p)≤8 newton, in certain embodiments F(p)≤6 newton, in certain embodiments F(p)≤4 newton, in certain embodiments F(p)≤3 newton, in certain embodiments F(p)≤2 newton, in certain embodiments F(p)≤1 newton.

In certain embodiments of the method according to the first aspect of the present disclosure, in step (I), a grinding force F(g) is applied by the grinding wheel to the glass sheet, in step (II), a polishing force F(p) is applied by the polishing wheel to the glass sheet, and 1.2≤F(g)/F(p)≤4.0, in certain embodiments 1.3≤F(g)/F(p)≤3.0, in certain embodiments 1.5≤F(g)/F(p)≤2.5, in certain embodiments 1.5≤F(g)/F(p)≤2.0.

In certain embodiments of the method according to the first aspect of the present disclosure, the polishing grits comprise a material selected from diamond, SiC, $CeO_2$, and combinations thereof.

In certain embodiments of the method according to the first aspect of the present disclosure, the polymer matrix is selected from a polyurethane resin, a epoxy, a posulfone, a polyetherketone, polyketone, polyimide, polyamide, polyolefins, and mixtures and combinations thereof.

In certain embodiments of the method according to the first aspect of the present disclosure, the polishing grits comprise a combination of diamond polishing grits and $CeO_2$ polishing grits.

In certain embodiments of the method according to the first aspect of the present disclosure, the diamond polishing grits have an average particle size of from 5 μm to 80 μm, in certain embodiments from 6 μm to 65 μm, in certain embodiments from 7 μm to 50 μm, in certain embodiments from 8 μm to 40 μm, in certain embodiments from 5 μm to 20 μm, in certain embodiments from 8 μm to 20 μm; and the $CeO_2$ polishing grits have an average particle size less than 5 μm, in certain embodiments less than 3 μm, in certain other embodiments less than 1 μm.

In certain embodiments of the method according to the first aspect of the present disclosure, the polishing wheel polymer matrix has a Shore D hardness of from 40 to 80, in certain embodiments from 45 to 70, in certain other embodiments from 50 to 60.

In certain embodiments of the method according to the first aspect of the present disclosure, the polishing wheel polymer matrix comprises a material selected from a polyurethane, an epoxy, cellulose and derivatives thereof, a polyolefin, and mixtures and combinations thereof.

In certain embodiments of the method according to the first aspect of the present disclosure, in step (I), the grinding wheel comprises, on the polishing surface, a pre-formed grinding groove having a cross-section perpendicular to the extending direction of the grinding groove with a maximal width Wm(gwg), an average with Wa(gwg) and a depth Dp(gwg), where Wm(gwg)>Th(gs), and Dp(gwg)≥50 μm, in certain embodiments Dp(gwg)≥100 μm, in certain embodiments Dp(gwg)≥150 μm, in certain embodiments Dp(gwg)≥200 μm, in certain embodiments Dp(gwg)≥250 μm, in certain embodiments Dp(gwg)≥350 μm, in certain embodiments Dp(gwg)≥400 μm, in certain embodiments Dp(gwg)≥450 μm, in certain embodiments Dp(gwg)≥500 μm, in certain embodiments Dp(gwg)≥1000 μm, in certain embodiments Dp(gwg)≥1500 μm.

In certain embodiments of the method according to the first aspect of the present disclosure, 1.2·Th(gs)≤Wm(gwg)≤3.0·Th(gs), in certain embodiments 1.5·Th(gs)≤Wm(gwg)≤2.5·Th(gs), in certain embodiments 1.5·Th(gs)≤Wm(gwg)≤2.0·Th(gs).

In certain embodiments of the method according to the first aspect of the present disclosure, in step (II), the polishing wheel comprises, on the polishing surface, a pre-formed polishing groove having a cross-section perpendicular to the extending direction of the polishing groove with a maximal width Wm(pwg), an average width Wa(pwg) and a depth Dp(pwg), where Wm(pwg)>Th(gs), and Dp(pwg)≥50 μm, in certain embodiments Dp(pwg)≥100 μm, in certain embodiments Dp(pwg)≥150 μm, in certain embodiments Dp(pwg)≥200 μm, in certain embodiments Dp(pwg)≥250 μm, in certain embodiments Dp(pwg)≥350 μm, in certain embodiments Dp(pwg)≥400 μm, in certain embodiments Dp(pwg)≥450 μm, in certain embodiments Dp(pwg)≥500 μm, in certain embodiments Dp(pwg)≥1000 μm, in certain embodiments Dp(pwg)≥1500 μm.

In certain embodiments of the method according to the first aspect of the present disclosure, 1.2·Th(gs)≤Wm(pwg)≤3.0·Th(gs), in certain embodiments 1.5·Th(gs)≤Wm(pwg)≤2.5·Th(gs), in certain embodiments 1.5·Th(gs)≤Wm(pwg)≤2.0·Th(gs).

In certain embodiments of the method according to the first aspect of the present disclosure, in steps (I) and (II), the first pre-finishing edge surface travels at a linear velocity of at least 1 $cm \cdot s^{-1}$, in certain embodiments at least 1 $cm \cdot s^{-1}$, in certain embodiments at least 2 $cm \cdot s^{-1}$, in certain embodiments at least 5 $cm \cdot s^{-1}$, in certain embodiments at least 10 $cm \cdot s^{-1}$, in certain embodiments at least 15 $cm \cdot s^{-1}$, in certain embodiments at least 20 $cm \cdot s^{-1}$, in certain embodiments at least 25 $cm \cdot s^{-1}$, in certain embodiments at least 30 $cm \cdot s^{-1}$, in certain embodiments at least 35 $cm \cdot s^{-1}$, in certain embodiments at least 40 $cm \cdot s^{-1}$, in certain embodiments at least 45 $cm \cdot s^{-1}$, in certain embodiments at least 50 $cm \cdot s^{-1}$, in certain embodiments at least 60 $cm \cdot s^{-1}$, in certain embodiments at least 70 $cm \cdot s^{-1}$, in certain embodiments at least 80 $cm \cdot s^{-1}$, in certain embodiments at least 90 $cm \cdot s^{-1}$, in certain embodiments at most 100 $cm \cdot s^{-1}$, in certain embodiments at most 80 $cm \cdot s^{-1}$, in certain other embodiments at most 70 $cm \cdot s^{-1}$, in certain other embodiments at most 60 $cm \cdot s^{-1}$, in certain other embodiments at most 50 $cm \cdot s^{-1}$.

One or more embodiments of the present disclosure has one or more of the following advantages. First, the use of a combination of a grinding wheel and a polishing wheel results in a combination of high throughput enabled by the high material removal in the grinding step and a high as-polished surface quality enabled by the gentle nature of the polishing wheel. Second, by using a grinding wheel and/or a polishing wheel with pre-formed groove, one can achieve consistent edge finishing speed and quality during the operational life of the wheel. Third, by choosing a polishing wheel having hard polishing grits and soft polishing grits embedded in a relatively soft and flexible polymer matrix material, one can reduce the SSDs formed as a result of the grinding step, and achieve a high surface quality of the as-polished edge surface in term of SSDs.

Additional features and advantages of the invention will be set forth in the detailed description which follows, and in part will be readily apparent to those skilled in the art from the description or recognized by practicing the invention as described in the written description and claims hereof, as well as the appended drawings.

It is to be understood that the foregoing general description and the following detailed description are merely exemplary of the invention, and are intended to provide an overview or framework to understanding the nature and character of the invention as it is claimed.

The accompanying drawings are included to provide a further understanding of the invention, and are incorporated in and constitute a part of this specification.

DETAILED DESCRIPTION

Figure 1:
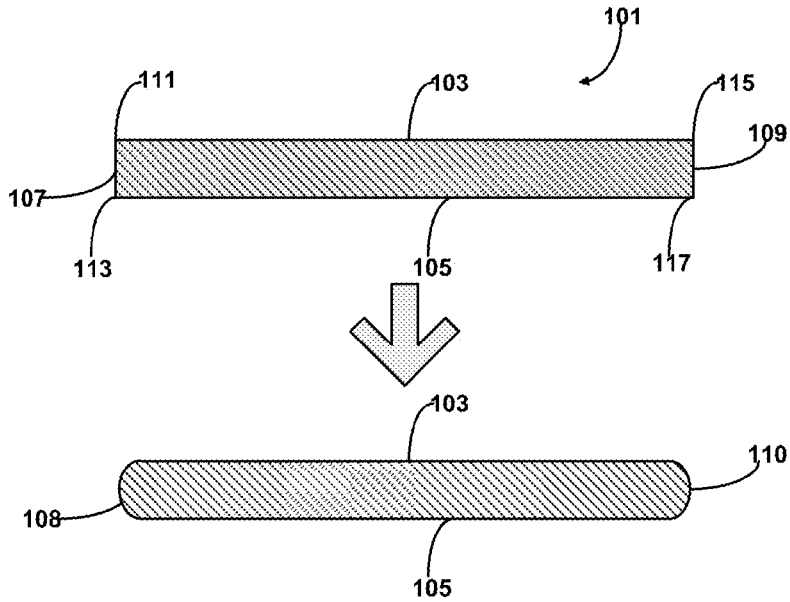
FIG. 1 is a schematic drawing showing the cross-section of a glass sheet with pre-finishing edges and post-finishing edges according to one embodiment of the present disclosure.

The method of the present disclosure is particularly advantageous for finishing glass sheets having a thickness of from about 10 um to about 1000 um, though it may be used for finishing glass sheets at other thickness, mutatis mutandis.

As mentioned supra in the background, as-cut glass sheet typically have edge surfaces substantially perpendicular to the major surfaces, which comprise micrometer-scale flaws such as sub-surface micro-cracks. The sharp edges are quite vulnerable to mechanical impact and can easily chip to form surface-contaminating glass chips. If the glass sheet is subjected to a stress, the cracks may further propagate causing the glass sheet breakage. To reduce chipping and breakage, it is highly desired to contour the edges and obtain a high smoothness thereof.

Without intending to be bound by a particular theory, it was indicated that the edge flaw size ('a') of a glass sheet is related to the stress ('σ') and fracture toughness (a material property, $K_{Ic}$) of the glass material by the following relationship:

$$K_{Ic}=1.12\sigma\sqrt{\pi a}.$$

Thus, it is clear that the best edge strength is obtained by minimizing the critical flaw size as they are inversely related.

Thus, a first aspect of the present disclosure relates to a method for finishing an edge of a glass sheet having a thickness Th(gs), a first major surface, a second major surface, and a first pre-finishing edge surface connecting the first major surface with the second major surface, a first corner defined by the intersection between the first major surface and the first pre-finishing edge surface, and a second corner defined by the intersection between the second major surface and the first pre-finishing edge surface, comprising the following steps:

(I) grinding the first edge surface, the first corner and the second corner to obtain a curved first ground edge surface with substantially no sharp corner having an as-ground maximal crack length MCL(g), an as-ground average crack length ACL(g), and an as-ground normalized average number of cracks ANC(g); and subsequently (II) polishing the first ground edge surface to obtain a first polished edge surface having an as-polished maximal crack length MCL(p), an as-polished average crack length ACL(p), and an as-polished normalized average number of cracks ANC(p); wherein MCL(p)/MCL(g)≤¾, ACL(p)/ACL(g)≤¾, and ANC(p)/ANC(g)≤¾.

Thus the finishing method of the present disclose is a two-step process involving a first grinding step and a subsequent polishing step. The combination of these two steps results in an optimal combination of high throughput and high final edge quality. The first grinding step results in fast removal of the majority of the glass material in the whole finishing step, effectively removing a great majority of the large sub-surfaces defects formed during an upstream glass sheet cutting process. In addition, the first grinding step results in the obtaining of a curved first ground edge surface with substantially the desired surface curvature by eliminating the sharp corners. Nonetheless, some of the pre-finishing edge defects may still remain, with the same or lower depth, at the end of the grinding step. Furthermore, due to the aggressive material removal measure of the grinding step, some sub-surface cracks may have been created in the process. In addition, the grinding step can result in a edge surface roughness not meeting the need of certain subsequent process requirements. In the method of the present disclosure, by including a polishing step after a grinding step, remaining sub-surface defects are further reduced and/or removed, and the edge quality and strength are brought to a new level. All three ratios, MCL(p)/MCL(g)≤¾, ACL(p)/ACL(g)≤¾, and ANC(p)/ANC(g)≤¾, indicate significant improvement in terms of severity and frequency of sub-surface defects as a result of the method of the present disclosure compared to a process involving a single step of grinding process only. The larger the ratios of MCL(p)/MCL(g), ACL(p)/ACL(g), and ANC(p)/ANC(g), the more materials would need to be removed by the polishing step (II), assuming step (I) is held constant.

FIG. 1 schematically illustrates the process according to one embodiment of the present disclosure. In this figure, an as-cut glass sheet 101 having a thickness Th(gs) obtained from a cutting step having a first major surface 103, a second major surface 105, a first pre-finishing edge surface 107 and a second pre-finishing edge surface 109 connecting the first major surface 103 with the second major surface 105. Both the pre-finishing edge surfaces 107 and 109 are substantially perpendicular to the major surfaces 103 and 105. As such, sharp corners 111, 113, 115 and 117 are defined at the intersection between the major surfaces and the pre-finishing edge surfaces. After the grinding and polishing steps according to the present disclosure, all four corners 111, 113, 115 and 117, in combination with part of the glass materials immediately below the edge surfaces 107 and 109, were removed, to form a curved first as-polished edge surface 108 and a curved second as-polished edge surface 110.

Figure 2A:
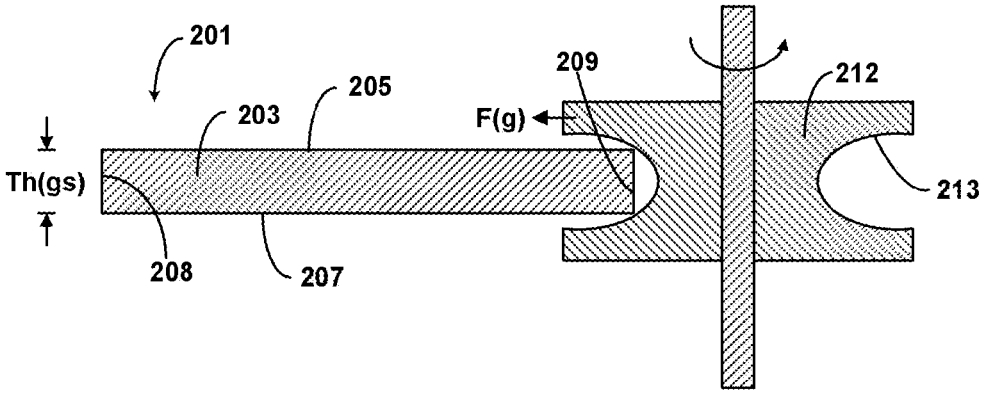
FIG. 2A is a schematic drawing showing a glass sheet being ground in a first grinding step according to one embodiment of the present disclosure.

FIG. 2A schematically illustrates a grinding step according to an embodiment of the present disclosure. In this embodiment, an as-cut glass sheet 201 having a first major surface 205 and a second major surface 207 as well as a substantially vertical pre-finishing edge surface 209 is subjected to grinding by a grinding wheel 212 having a pre-formed grinding wheel groove 213, which rotates around a spindle. In this grinding step, both corners of the cross-sections of the first and second major surfaces 205 and 207 are being ground simultaneously by the grinding wheel groove 213 while the first edge surface 209 travels in a direction substantially perpendicular to the surface of cross-section of the glass sheet illustrated in this figure. During grinding, a grinding force F(g) is applied by the grinding wheel 212 to the glass sheet 203, which allows for the removal of the glass material from the corners and the edge surface of the glass sheet. While the use of a single grinding wheel 212 is advantageous in certain embodiments, one skilled in the art, upon reading the present disclosure, can understand that the present invention maybe applied in embodiments where multiple grinding wheels are used, each for grinding a separate corner region only. FIG. 2A shows the grinding of the first pre-finishing edge surface 209 only. In practice, one may grind the opposing second pre-finishing edge surface 208 simultaneously (not shown) or in a separate grinding operation.

Figure 2B:
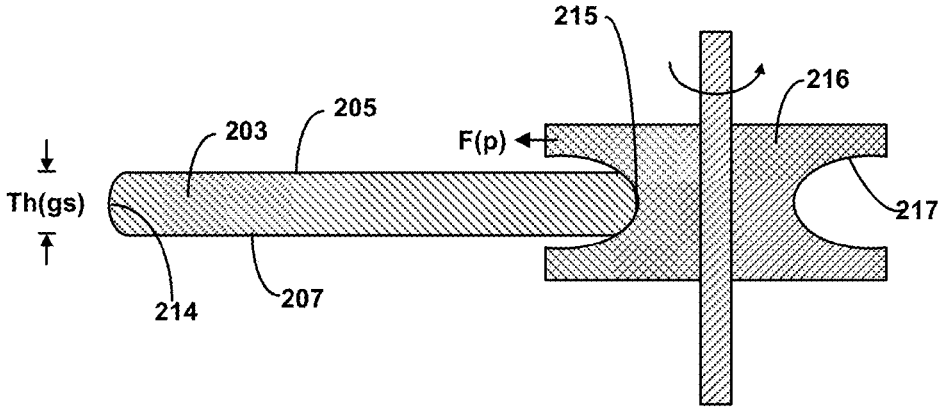
FIG. 2B is a schematic drawing showing the glass sheet having been ground according to FIG. 2A being polished in a second polishing step according to the same embodiment of FIG. 2A.

FIG. 2B schematically illustrates a polishing step according to the same embodiment associated with the grinding step illustrated in FIG. 2A. in this embodiment, the as-ground glass sheet 201 with the first pre-finishing edge 209 ground to a curved first as-ground edge surface 215 is further subjected to polishing by a polishing wheel 216 having a pre-formed polishing wheel groove 217, which rotates around a spindle. In this embodiment, the entire as-ground first edge surface 215 is being polished by the polishing wheel groove 217 while the first as-ground edge surface 215 travels in a direction substantially perpendicular to the cross-section of the glass sheet illustrated in this figure. During polishing, a polishing force F(p) is applied by the polishing wheel 216 to the glass sheet 203, which allows for the further removal of glass material from the as-ground edge surface 215. While the embodiment shown in this figure using a single polishing wheel can be advantageous in certain embodiments, one skilled in the art, with the benefit of the disclosure herein, should understand that the present invention maybe applied to embodiments where multiple polishing wheel is used, each for polishing a given area of the as-ground edge surface. FIG. 2B shows the polishing of the first as-ground edge surface 215 only. In practice, one may polish the opposing second as-ground edge surface 214 simultaneously (not shown) or in a separate polishing operation. In a particularly advantageous embodiment, the grinding step of the first pre-finishing edge surface 209 shown in FIG. 2A and the polishing step of the first as-ground edge surface 215 shown in FIG. 2B are carried out substantially simulataneously in a single finishing operation, with the ground wheel 212 located slight upstream to the polishing wheel 216, such that the first pre-finishing edge surface 209 can be processed into an as-polished surface 215 at the end of a single pass through the edge-finishing machine.

Figure 3:
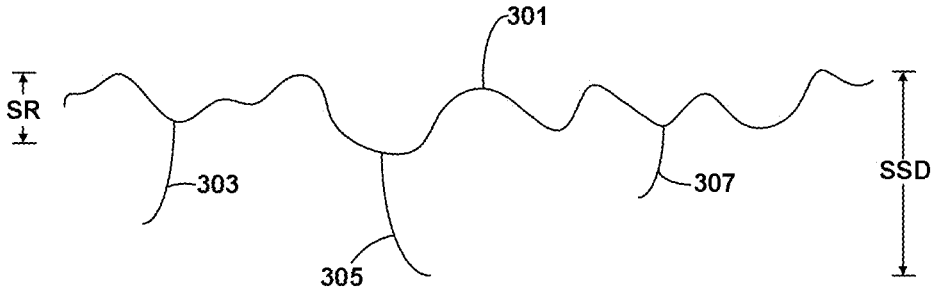
FIG. 3 is a schematic drawing showing the surface and sub-surface damage of an edge surface of a glass sheet.

When viewed at a sufficiently high resolution, any real surface exhibits certain roughness. This is true for the pre-finishing edge surface, the as-ground edge surface and the as-polished edge surface. FIG. 3 schematically illustrates surface features of one of such surfaces 301, including surface peak-to-valley undulations called surface roughness (shown as SR) and sub-surface defects (shown as SSD) 303, 305 and 307 with various depth of reach. The sub-surface damages, when they are large, may be visible under an optical microscope. However, for the majority of them, which have merely sub-micron gap, they are typically not directly detectable under an optical microscope. Thus, to characterize and quantify the presence, frequency and depth of the sub-surface microcracks (also known as sub-surface damage, SSD), one would need a method to reveal the microcracks to make them observable. An approach developed by the present inventors, which are used in measuring all the cracks to be described infra, is as follows.

An edge finished large glass sheet is cut to approximately 1"×1" (2.54 cm by 2.54 cm) squares by scoring followed by bending-separation. Care is taken to ensure that the scoring of large glass sheet is performed from the side opposite to the finished edge to be measured, thus the profile of the measured edge does not have any score marks which may interfere with inspection and measurement.

The square samples are then etched using the following process: (i) immersing the whole square samples in a 5% HF+5% HCl solution for 30 seconds without agitation; (ii) taking the square samples out of the acid; and then (iii) rinsing ad cleaning with process water. Care is taken to ensure that no acid remains on the square sample surface.

The square samples are then inspected under an optical microscope. The samples are placed under the microscope such that the profile (cross section) of edge is visible. The magnification is changed from 100 times to 500 times to inspect flaws (sub-surface damages, SSDs) on the edge of the profile. For smaller cracks, higher magnification is used, and vice versa. Also 200× optical images of the profiles are captured and then analyzed.

During image analysis, the measurements are performed by drawing two parallel lines in the images on the computer screen at the two ends of the SSD substantially perpendicular to the direction of the SSD, and computing the distance between the lines, which is recorded as the length of the SSD. All visible SSD under the microscope are measured and the maximum and average length are computed. SSD frequency, i.e., normalized average number of cracks, is defined as the total number of SSDs per unit length along the curve profile of the cross-section of the edge.

In certain particularly advantageous embodiments, MCL(p)/MCL(g)≤½, ACL(p)/ACL(g)≤½, and ANC(p)/ANC(g)≤½. In certain other particularly advantageous embodiments, MCL(p)/MCL(g)≤⅓, ACL(p)/ACL(g)≤⅓, and ANC(p)/ANC(g)≤⅓. In certain other particularly advantageous embodiments, MCL(g)≤40 μm, ACL(g)≤10 μm, and ANC(p)≤40 $mm^{-1}$. In certain other particularly advantageous embodiments, MCL(g)≤20 μm, ACL(g)≤5 μm, and ANC(p)≤20.

The grinding wheel used in step (I) may advantageously comprise a number of grinding grits embedded in a grinding wheel matrix. The grinding grits normally have a hardness at least as high as that of the glass material to be ground. Examples of grinding grits in the grinding wheel include, but are not limited to, diamond, SiC, SiN, and combinations thereof. The matrix holds the grinding grits together. Examples of the material for the matrix include, but are not limited to, iron, stainless steel, ceramic, glass, and the like. Because significant amount of glass material is removed in step (I), it is highly desired that the grinding wheel matrix materials is relatively hard and rigid. In addition, to avoid abrasion of the matrix it is desired that the grinding grits protrude above the surface of the matrix material, and during grinding, direct contact between the matrix material and the glass sheet to be ground is avoided. During grinding, the friction between the grinding grits and the glass material causes the removal of the glass material from the corners and the edge surfaces. Overtime, both the matrix and the grinding grits may be consumed.

During the grinding step (I), the grinding wheel and the glass edge surface subjected to grinding are advantageously cooled by a fluid, more advantageously a liquid such as water. Water is particularly advantageous due to the low cost, its ability to lubricate the process, carry away the glass particles generated, while cooling the wheel and the glass sheet.

The parameters of the grinding grits, particularly size, geometry, packing density in the wheel, distribution of the grinding grits on the wheel surface, and material hardness, impact the grinding effectiveness, material removal speed, surface roughness and sub-surface damage at the end of the grinding step (I). Thus, in certain advantageous embodiments, in step (I), the grinding grits have an average particle size of from 10 μm to 80 μm, in certain embodiments from 20 μm to 65 μm, in certain embodiments from 20 μm to 45 μm, in certain embodiments from 20 μm to 40 μm.

A grinding force applied by the grinding wheel to the glass sheet being ground determines the friction force between the grinding wheel and the glass material, hence the material removal speed, and amount and severity of the sub-surface damage (SSD). When grinding a glass sheet having a thickness of at most 1000 μm, it is desirable that the grinding force $F(g) \leq 30$ newton, in certain embodiments $F(g) \leq 25$ newton, in certain embodiments $F(g) \leq 20$ newton, in certain embodiments $F(g) \leq 15$ newton, in certain embodiments $F(g) \leq 10$ newton, in certain embodiments $F(g) \leq 8$ newton, in certain embodiments $F(g) \leq 6$ newton, in certain embodiments $F(g) \leq 4$ newton.

The polishing wheel used in step (II) may advantageously comprise a number of polishing grits embedded in a polishing wheel polymer matrix. At least some of the polishing grits normally have a hardness at least as high as that of the glass material to be polished. Examples of polishing grits in the polishing wheel include, but are not limited to, diamond, SiC, SiN, $Al_2O_3$, BN, $CeO_2$, and combinations thereof. Thus, in certain advantageous embodiments, in step (II), the polishing grits have an average particle size of from 5 μm to 80 μm, in certain embodiments from 6 μm to 65 μm, in certain embodiments from 7 μm to 50 μm, in certain embodiments from 8 μm to 40 μm, in certain embodiments from 5 μm to 20 μm, in certain embodiments from 8 μm to 20 μm. Compared to the grinding grits in the grinding wheel, the polishing grits desirably have at least one of (i) a lower hardness, (ii) smaller grit particle size, (iii) lower density of grit particles in terms of number of grit particles per unit volume of the polymer matrix, in order to obtain a lower material removal speed and lower SSD as a result of the polishing step (II).

In a particularly advantageous embodiment, the polishing grits comprise a combination of diamond polishing grits and $CeO_2$ polishing grits. Without intending to be bound by a particular theory, it is believed that the diamond polishing grits, having a high hardness, provides the effectiveness of material removal, while the $CeO_2$ polishing grits, at a lower hardness than diamond particles, provide the polishing function and more gentle material removal ability, resulting in an optimized combination of material removal speed and polishing function for step (II). In such embodiments, it is desirable that the diamond polishing grits have an average particle size of from 5 μm to 80 μm, in certain embodiments from 6 μm to 65 μm, in certain embodiments from 7 μm to 50 μm, in certain embodiments from 8 μm to 40 μm, in certain embodiments from 5 μm to 20 μm, in certain embodiments from 8 μm to 20 μm; and the $CeO_2$ polishing grits have an average particle size less than 5 μm, in certain embodiments less than 3 μm, in certain other embodiments less than 1 μm.

The polymer matrix holds the polishing grits together. Examples of the material for the polymer matrix include, but are not limited to, polyurethanes, epoxies, polyester, polyethers, polyetherketones, polyamides, polyimides, polyolefins, polysaccharides, polysulfones, and the like. It is highly desired that the polymer matrix material of the polishing wheel has a higher flexibility than the grinding wheel matrix material. During polishing, the friction between the polishing grits and the glass material causes the removal of the glass material from the as-ground surfaces. Overtime, both the polymer matrix and the polishing grits may be consumed.

During the polishing step (II), the polishing wheel and the glass edge surface subjected to polishing are advantageously cooled by a fluid, more advantageously a liquid such as water. Water is particularly advantageous due to the low cost, its ability to lubricate the process, carry away the glass particles generated, while cooling the wheel and the glass sheet.

The parameters of the polishing grits, particularly size, geometry, packing density in the wheel, and material hardness, impact the polishing effectiveness, material removal speed, surface roughness and sub-surface damage at the end of the polishing step (II).

A polishing force applied by the polishing wheel to the glass sheet being ground determines the friction force between the polishing wheel and the glass material, hence the material removal speed, and amount and severity of the sub-surface damage (SSD). When polishing a glass sheet having a thickness of at almost 1000 μm, it is desirable that the polishing force F(p) is applied by the polishing wheel to the glass sheet, and $F(p) \leq 30$ newton, in certain embodiments $F(p) \leq 25$ newton, in certain embodiments $F(p) \leq 20$ newton, in certain embodiments $F(p) \leq 15$ newton, in certain embodiments $F(p) \leq 10$ newton, in certain embodiments $F(p) \leq 8$ newton, in certain embodiments $F(p) \leq 6$ newton, in certain embodiments $F(p) \leq 4$ newton. Depending on the choice of the polishing material, especially the polishing grit material, it may be highly desirable in certain embodiments that $F(p) < F(g)$, in certain embodiments $F(p) < \frac{3}{4} \cdot F(g)$, in certain embodiments $F(p) < \frac{1}{2} \cdot F(g)$, in certain embodiments $F(p) < \frac{1}{3} \cdot F(g)$, in certain embodiments $F(p) < \frac{1}{4} \cdot F(g)$.

The hardness of the polymer matrix material of the polishing wheel has impact on the glass material removal rate and the polished surface quality as well. This is because a low hardness, highly flexible polymer matrix can effectively result in a significantly lower force applied by the polishing grit particles to the glass material than a harder polymer matrix would. Thus, in certain embodiments, it is desirable that the polishing wheel polymer matrix has a Shore D hardness of from 40 to 80, in certain embodiments from 45 to 70, in certain other embodiments from 50 to 60.

In a particularly advantageous embodiment, a pre-formed grinding wheel surface groove having a cross-section in the radial direction of the wheel with a maximal width Wm(gwg), an average with Wa(gwg) and a depth Dp(gwg), where $Wm(gwg) > Th(gs)$, and $Dp(gwg) \geq 50$ μm, in certain embodiments $Dp(gwg) \geq 100$ μm, in certain embodiments $Dp(gwg) \geq 150$ μm, in certain embodiments $Dp(gwg) \geq 200$ μm, in certain embodiments $Dp(gwg) \geq 250$ μm, in certain embodiments $Dp(gwg) \geq 350$ μm, in certain embodiments $Dp(gwg) \geq 400$ μm, in certain embodiments $Dp(gwg) \geq 450$ μm, in certain embodiments $Dp(gwg) \geq 500$ μm, in certain embodiments $Dp(gwg) \geq 1000$ μm, in certain embodiments $Dp(gwg) \geq 1500$ μm. The grinding groove receives the pre-finishing edge before grinding starts, and ensures a proper, consistent amount of material removal in all grinding operations, from the beginning of the service life of the grinding wheel to the end thereof, so that a consistent edge surface geometry and dimension is obtained among glass sheets finished by using the same grinding wheel. In certain particularly advantageous embodiments, $1.2 \cdot Th(gs) \leq Wm(gwg) \leq 3.0 \cdot Th(gs)$, in certain embodiments $1.5 \cdot Th(gs) \leq Wm(gwg) \leq 2.5 \cdot Th(gs)$, in certain embodiments $1.5 \cdot Th(gs) \leq Wm(gwg) \leq 2.0 \cdot Th(gs)$.

Figure 4:
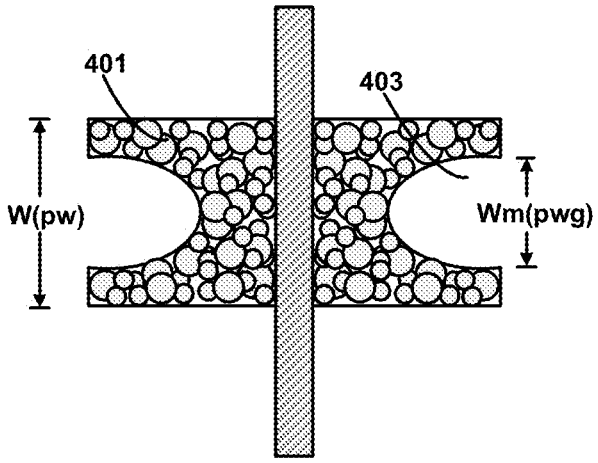
FIG. 4 is a schematic drawing showing the cross-section of a polishing wheel used in one embodiment of the present disclosure.

In a particularly advantageous embodiment, illustrated in FIG. 4, the polishing wheel 401 having an overall wheel width W(pw) comprises a pre-formed polishing wheel surface groove 403 having a cross-section in the radial direction of the wheel with a maximal width Wm(pwg), an average width Wa(pwg) and a depth Dp(pwg), where Wm(pwg)>Th(gs), and Dp(pwg)≥50 μm, in certain embodiments Dp(pwg)≥100 μm, in certain embodiments Dp(pwg)≥150 μm, in certain embodiments Dp(pwg)≥200 μm, in certain embodiments Dp(pwg)≥250 μm, in certain embodiments Dp(pwg)≥350 μm, in certain embodiments Dp(pwg)≥400 μm, in certain embodiments Dp(pwg)≥450 μm, in certain embodiments Dp(pwg)≥500 μm, in certain embodiments Dp(pwg)≥1000 μm, in certain embodiments Dp(pwg)≥1500 μm. The polishing groove receives the as-ground edge before polishing starts, and ensures a proper, consistent amount of material removal in all polishing operations, from the beginning of the service life of the polishing wheel to the end thereof, so that a consistent as-polished edge surface geometry and dimension is obtained among glass sheets finished by using the same polishing wheel. In certain particularly advantageous embodiments, $1.2 \cdot Th(gs) \leq Wm(pwg) \leq 3.0 \cdot Th(gs)$, in certain embodiments $1.5 \cdot Th(gs) \leq Wm(pwg) \leq 2.5 \cdot Th(gs)$, in certain embodiments $1.5 \cdot Th(gs) \leq Wm(pwg) \leq 2.0 \cdot Th(gs)$.

Figure 5:
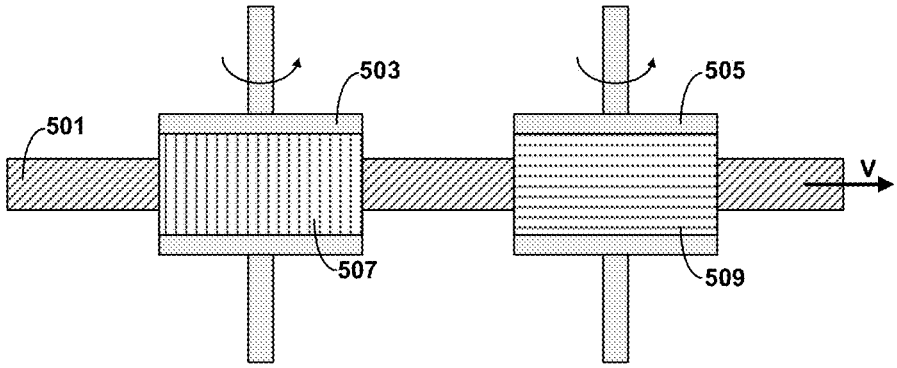
FIG. 5 is a schematic drawing showing a glass sheet being ground and polished in a single pass according to one embodiment of the present disclosure.

As mentioned supra, in a particularly advantageous embodiment, a pre-finishing edge surface of a glass sheet is subjected to the grinding step (I) and the polishing step (II) in a single finishing step, wherein the edge surface travels at a linear velocity with respect to the center of the grinding wheel and the center of the polishing wheel. FIG. 5 schematically illustrates this embodiment, where an edge surface 501 of a glass sheet is received by a grinding groove 507 of a grinding wheel 503, subjected to grinding first, and then travels to the downstream polishing location, where it is received by the polishing groove 509 of a polishing wheel 505. The velocity of the edge surface 501 with respect to the center of the grinding wheel 503 and the center of the polishing wheel 505 is V. in certain embodiments it is desired that V is at least 1 $cm \cdot s^{-1}$, in certain embodiments at least 2 $cm \cdot s^{-1}$, in certain embodiments at least 5 $cm \cdot s^{-1}$, in certain embodiments at least 10 $cm \cdot s^{-1}$, in certain embodiments at least 15 $cm \cdot s^{-1}$, in certain embodiments at least 20 $cm \cdot s^{-1}$, in certain embodiments at least 25 $cm \cdot s^{-1}$, in certain embodiments at least 30 $cm \cdot s^{-1}$, in certain embodiments at least 35 $cm \cdot s^{-1}$, in certain embodiments at least 40 $cm \cdot s^{-1}$, in certain embodiments at least 45 $cm \cdot s^{-1}$, in certain embodiments at least 50 $cm \cdot s^{-1}$, in certain embodiments at least 60 $cm \cdot s^{-1}$, in certain embodiments at least 70 $cm \cdot s^{-1}$, in certain embodiments at least 80 $cm \cdot s^{-1}$, in certain embodiments at least 90 $cm \cdot s^{-1}$, in certain embodiments at most 100 $cm \cdot s^{-1}$, in certain embodiments at most 80 $cm \cdot s^{-1}$, in certain other embodiments at most 70 $cm \cdot s^{-1}$, in certain other embodiments at most 60 $cm \cdot s^{-1}$, in certain other embodiments at most 50 $cm \cdot s^{-1}$. While only one grinding wheel and one polishing wheel are shown in FIG. 5, it is possible to use a series of grinding wheels, same or different, to perform the grinding function, followed by a series of polishing wheels, same or different, to perform the polishing function to the intended degree, in a single pass finishing process. For example, in one embodiment where a series of grinding wheels are used, from the first to the last in the order of contacting a specific point on the glass sheet edge, the grinding grits may become increasingly smaller to provide increasingly more gentle grinding function. Likewise, in one embodiment where a series of polishing wheels are used, from the first to the last in the order of contacting a specific point on the glass sheet edge, the polishing grits may become increasingly smaller to provide increasing more gentle polishing function. Still in another embodiment where a series of polishing wheels are used, from the first to the last wheel, increasingly softer polymer matrix material may be used, to achieve the intended final polishing function and low SSDs.

The method of the present disclosure, by utilizing the proper grinding process parameters and the polishing process parameters, achieves a high glass sheet velocity, hence a high finishing throughput, in combination with high as-polished edge surface quality, especially in terms of SSDs.

In one embodiment, the method used for making surface groove 403 on the polishing wheel 401 is as follows: A tool with the inverse profile of the groove shape is created by machining a metal (for example, stainless steel) which serves as the core. The core is then plated (with metals such as nickel, copper or bronze etc.) so that a layer of abrasive grains (such as diamond) can be bonded on to the steel core. Such as tool, commonly referred to as an electroplated tool, is used to grind the profile in to the periphery of the wheel. The process can be dry or wet and depending on the tolerances could be a two step process with rough and fine grinding. In certain particularly advantageous embodiments, the wheel run-out (out-of-roundness) is checked before a groove is machined. If the run-out is higher than a given tolerance, then the wheel is first trued before the groove is machined. If necessary, the diamond grains in the groove are exposed by dressing the groove using aluminum oxide (alumina).

The present invention is further illustrated by the following non-limiting examples.

EXAMPLES

Aluminoborosilicate glass sheets having a thickness of 700 μm were ground at an edge by using a grinding wheel. The as-ground surface was then measured for SSD according to the measurement protocol described supra. The as-ground surfaces of multiple sheets were then polished using two different polishing wheels, one according to the present disclosure and one according to a comparative example. The as-polished surfaces were then measured for SSDs according to the same protocol.

Figure 6:
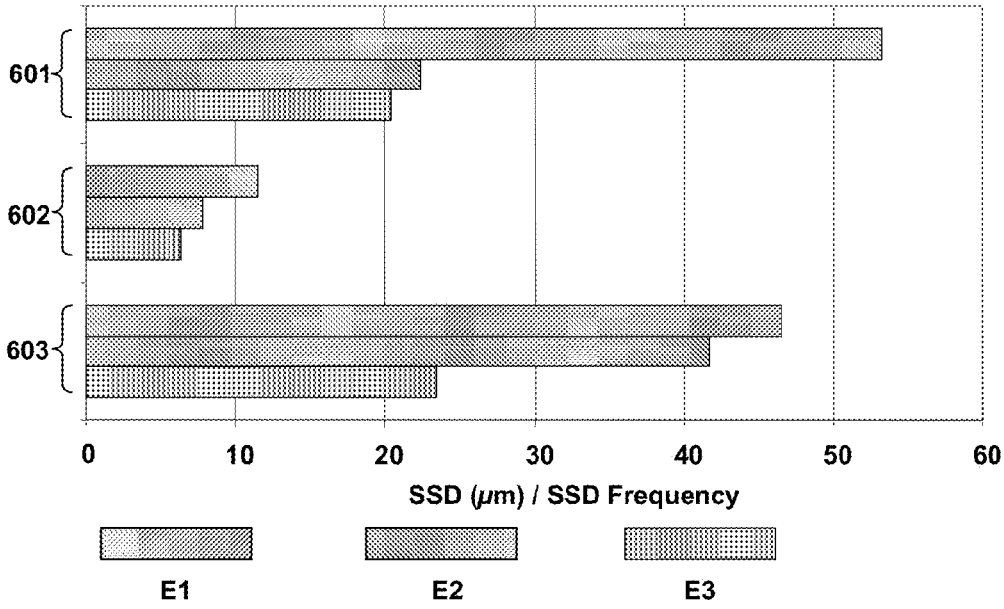
FIG. 6 is a diagram comparing the edge surface quality of as-ground surface, as-polished surface according to a comparison embodiment and as-polished surface according to an embodiment of the present disclosure.

The test results are plotted into a chart shown in FIG. 6. In this figure, bars E1 indicate as-ground surface, bars E2 indicate as-polished surface in the comparative example, and bars E3 indicate as-polished surface in the example according to the present disclosure, bars 601 indicate measured maximal SSD (μm), bars 602 indicate measured average SSD (μm), and bars 603 indicate SSD frequency (i.e., normalized average number of cracks).

From FIG. 6, it is clear that the method of the present invention results in a much smaller maximal SSD, average SSD and SSD frequency.

Figure 7:
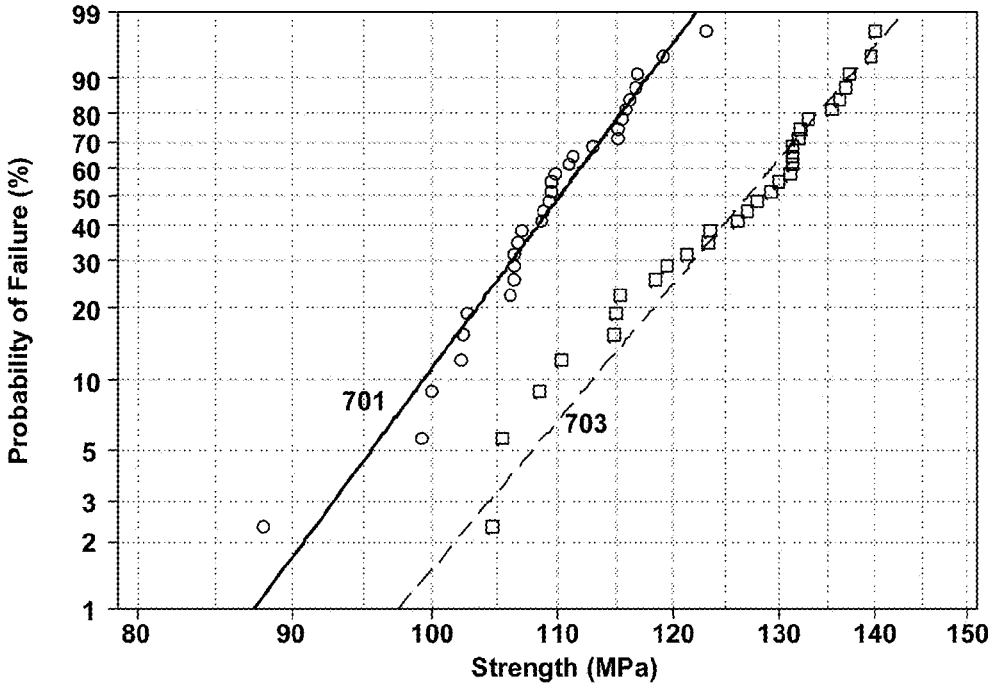
FIG. 7 is a diagram comparing the strength of the edge of a glass sheet finished using a comparison process and that of a glass sheet finished using a process according to one embodiment of the present disclosure.

The edges of the glass sheets as polished in the above two examples were then measured for strength using a vertical 4-point bending test. The results are shown in FIG. 7. The round data points and the linear fitting curve 701 are for the glass sheets polished in the comparative example, and the square data points and the linear fitting curve 703 are for the glass sheets polished in the example according to the present disclosure. Comparison of curves 701 and 703 clearly indicates that the method of the present disclosure resulted in significantly improved edge strength.

It will be apparent to those skilled in the art that various modifications and alterations can be made to the present invention without departing from the scope and spirit of the invention. Thus, it is intended that the present invention cover the modifications and variations of this invention provided they come within the scope of the appended claims and their equivalents.

What is claimed is:

1. A method for finishing an edge of a glass sheet having a thickness Th(gs) a first major surface, a second major surface, and a first pre-finishing edge surface connecting the first major surface with the second major surface, a first corner defined by the intersection between the first major surface and the first pre-finishing edge surface, and a second corner defined by the intersection between the second major surface and the first pre-finishing edge surface, comprising the following steps:

(I) grinding the first pre-finishing edge surface, the first corner and the second corner with a grinding wheel to obtain a curved first ground edge surface with substantially no sharp corner having an as-ground maximal sub-surface crack length MCL(g), an as-ground average sub-surface crack length ACL(g), and an as-ground normalized average number of sub-surface cracks ANC(g); and subsequently (II) polishing the curved first ground edge surface with a polishing wheel to obtain a first polished edge surface having an as-polished maximal sub-surface crack length MCL(p), an as-polished average sub-surface crack length ACL(p), and an as-polished normalized average number of sub-surface cracks ANC(p);

wherein the grinding step and the polishing step are performed such that MCL(p)/MCL(g)≤¾, ACL(p)/ACL(g)≤¾, and ANC(p)/ANC(g)≤¾.

2. A method according to claim 1, wherein MCL(p)/MCL(g)≤⅔, ACL(p)/ACL(g)≤⅔, and ANC(p)/ANC(g)≤⅔.

3. A method according to claim 1, wherein MCL(p)/MCL(g)≤½, ACL(p)/ACL(g)≤½, and ANC(p)/ANC(g)≤½.

4. A method according to claim 1, wherein MCL(p)/MCL(g)≤⅓, ACL(p)/ACL(g)≤⅓, and ANC(p)/ANC(g)≤⅓.

5. A method according to claim 1, wherein MCL(g)≤40 μm, ACL(g)≤10 μm, and ANC(p)≤40 $mm^{-1}$.

6. A method according to claim 1, wherein in step (I), the grinding wheel comprising a plurality of grinding grits embedded in a grinding wheel matrix is used, and the grinding grits have an average particle size of from 10 μm to 80 μm.

7. A method according to claim 6, wherein the grinding grits comprise a material selected from diamond, SiC, $Al_2O_3$, SiN, BN, and combinations thereof.

8. A method according to claim 6, wherein in step (I), a grinding force F(g) is applied by the grinding wheel to the glass sheet, and F(g)≤30 newton.

9. A method according to claim 1, wherein in step (II), the polishing wheel comprising a plurality of polishing grits embedded in a polishing wheel polymer matrix is used, and the polishing grits have an average particle size of from 5 μm to 80 μm.

10. A method according to claim 9, wherein in step (II), a polishing force F(p) is applied by the polishing wheel to the glass sheet, and F(p)≤30 newton.

11. A method according to claim 1, wherein in step (I), a grinding force F(g) is applied by the grinding wheel to the glass sheet, in step (II), a polishing force F(p) is applied by the polishing wheel to the glass sheet, and 1.2≤F(g)/F(p)≤4.0.

12. A method according to claim 9, wherein the polishing grits comprise a material selected from diamond, SiC, $CeO_2$, and combinations thereof.

13. A method according to claim 9, wherein the polymer matrix is selected from a polyurethane resin, a epoxy, a posulfone, a polyetherketone, polyketone, polyimide, polyamide, polyolefins, and mixtures and combinations thereof.

14. A method according to claim 9, wherein the polishing grits comprise a combination of diamond polishing grits and $CeO_2$ polishing grits.

15. A method according to claim 12, wherein the diamond polishing grits have an average particle size of from 5 μm to 80 μm.

16. A method according to claim 9, wherein the polishing wheel polymer matrix has a Shore D hardness of from 40 to 80.

17. A method according to claim 16, wherein 1.2·Th(gs)≤Wm(gwg)≤3.0·Th(gs).

18. A method according to claim 1, wherein in step (II), the polishing wheel comprises, on the polishing surface, a preformed polishing groove having a cross-section perpendicular to the extending direction of the polishing groove with a maximal width Wm(pwg), an average width Wa(pwg) and a depth Dp(pwg), where Wm(pwg)>Th(gs), and Dp(pwg)≥50 μm.

19. A method according to claim 18, wherein 1.2·Th(gs)≤Wm(pwg)≤3.0·Th(gs).

20. A method according to claim 1, wherein in steps (I) and (II), the first pre-finishing edge surface travels at a linear velocity of at least 1 $cm \cdot s^{-1}$.

21. A method according to claim 1, further comprising steps of using an optical microscope and a computer to determine the MCL(p), the MCL(g), the ACL(p), the ACL(g), the ANC(p) and the ANC(g).

22. A method for finishing an edge of a glass sheet having a thickness Th(gs) a first major surface, a second major surface, and a first pre-finishing edge surface connecting the first major surface with the second major surface, a first corner defined by the intersection between the first major surface and the first pre-finishing edge surface, and a second corner defined by the intersection between the second major surface and the first pre-finishing edge surface, comprising the following steps:

(I) grinding the first pre-finishing edge surface, the first corner and the second corner using a grinding wheel to obtain a curved first ground edge surface with substantially no sharp corner having an as-ground maximal sub-surface crack length MCL(g), an as-ground average sub-surface crack length ACL(g), and an as-ground normalized average number of sub-surface cracks ANC(g); and subsequently (II) polishing the curved first ground edge surface using a polishing wheel to obtain a first polished edge surface having an as-polished maximal sub-surface crack length MCL(p), an as-polished average sub-surface crack length ACL(p), and an as-polished normalized average number of sub-surface cracks ANC(p);

wherein the grinding step and the polishing step are performed such that MCL(p)/MCL(g)≤¾, ACL(p)/ACL(g)≤¾, and ANC(p)/ANC(g)≤¾;

wherein in step (I), the grinding wheel comprising a plurality of grinding grits embedded in a grinding wheel matrix is used, and the grinding grits have an average particle size of from 10 μm to 80 μm;

wherein in step (I), a grinding force F(g) is applied by the grinding wheel to the glass sheet, and F(g)≤30 newton;

wherein in step (II), the polishing wheel comprising a plurality of polishing grits embedded in a polishing wheel polymer matrix is used, and the polishing grits have an average particle size of from 5 μm to 80 μm; and wherein in step (II), a polishing force F(p) is applied by the polishing wheel to the glass sheet, and F(p)≤30 newton.

23. The method according to claim 1, further comprising steps of using an optical microscope and a computer to determine the MCL(p), the MCL(g), the ACL(p), the ACL(g), the ANC(p) and the ANC(g).

24. A system for finishing an edge of a glass sheet having a thickness Th(gs) a first major surface, a second major surface, and a first pre-finishing edge surface connecting the first major surface with the second major surface, a first corner defined by the intersection between the first major surface and the first pre-finishing edge surface, and a second corner defined by the intersection between the second major surface and the first pre-finishing edge surface, the system comprising:

a grinding wheel configured to grind the first pre-finishing edge surface, the first corner and the second corner to obtain a curved first ground edge surface with substantially no sharp corner having an as-ground maximal sub-surface crack length MCL(g), an as-ground average sub-surface crack length ACL(g), and an as-ground normalized average number of sub-surface cracks ANC(g); and a polishing wheel configured to polish the curved first ground edge surface to obtain a first polished edge surface having an as-polished maximal sub-surface crack length MCL(p), an as-polished average sub-surface crack length ACL(p), and an as-polished normalized average number of sub-surface cracks ANC(p);

wherein the grinding wheel is configured to grind the first edge surface and the polishing well is configured to polish the first ground edge surface such that MCL(p)/MCL(g)≤¾, ACL(p)/ACL(g)≤¾, and ANC(p)/ANC(g)≤¾;

wherein the grinding wheel comprising a plurality of grinding grits embedded in a grinding wheel matrix, and the grinding grits have an average particle size of from 10 μm to 80 μm;

wherein the grinding wheel is configured to apply a grinding force F(g) to the glass sheet, and F(g)≤30 newton;

wherein the polishing wheel comprising a plurality of polishing grits embedded in a polishing wheel polymer matrix, and the polishing grits have an average particle size of from 5 μm to 80 μm; and wherein the polishing wheel is configured to apply a polishing force F(p) to the glass sheet, and F(p)≤30 newton.

25. The system according to claim 1, further comprising an optical microscope and a computer to determine the MCL(p), the MCL(g), the ACL(p), the ACL(g), the ANC(p) and the ANC(g).

* * * * *

UNITED STATES PATENT AND TRADEMARK OFFICE

CERTIFICATE OF CORRECTION

PATENT NO. : 8,721,392 B2
APPLICATION NO. : 13/170728
DATED : May 13, 2014
INVENTOR(S) : James William Brown and Siva Venkatachalam It is certified that error appears in the above-identified patent and that said Letters Patent is hereby corrected as shown below:

In the Claims:

Column 16 Lines 7-9

In claim 24:

4th paragraph, second line replace "wherein the grinding wheel is configured to grind the first edge surface and the polishing well is configured to polish the first ground edge surface" with --wherein the grinding wheel is configured to grind the first edge surface and the polishing wheel is configured to polish the first ground edge surface--

Signed and Sealed this
Nineteenth Day of August, 2014

Michelle K. Lee

Michelle K. Lee
*Deputy Director of the United States Patent and Trademark Office*